US007740454B2

(12) United States Patent
Kim et al.

(10) Patent No.: US 7,740,454 B2
(45) Date of Patent: Jun. 22, 2010

(54) THERMAL ACTUATION PUMP

(75) Inventors: Tae-gyun Kim, Suwon-si (KR); Young-ki Hong, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 769 days.

(21) Appl. No.: 11/222,816

(22) Filed: Sep. 12, 2005

(65) Prior Publication Data

US 2006/0078434 A1 Apr. 13, 2006

(30) Foreign Application Priority Data

Sep. 14, 2004 (KR) ..... 10-2004-0073413

(51) Int. Cl.
*F04B 19/24* (2006.01)

(52) U.S. Cl. ..... 417/52; 417/207; 417/395; 417/413.1

(58) Field of Classification Search ..... 417/395, 417/413.1, 48–51, 52, 505, 322; 92/96; 62/3.3; 310/306, 307; 60/527, 528; 318/117
See application file for complete search history.

(56) References Cited

U.S. PATENT DOCUMENTS 2,910,836 A * 11/1959 Karrer ..... 62/3.3
4,390,325 A * 6/1983 Elo et al. ..... 417/379
4,640,667 A * 2/1987 Trepp ..... 417/52
4,751,821 A * 6/1988 Birchard ..... 60/698
5,423,479 A * 6/1995 Nichols ..... 236/49.3
5,537,860 A * 7/1996 Haertl ..... 73/54.14
6,007,302 A * 12/1999 Welle ..... 417/52
6,059,546 A * 5/2000 Brenan et al. ..... 417/534
6,449,959 B1 * 9/2002 Garcia ..... 62/3.7
2004/0115068 A1 * 6/2004 Hansen et al. ..... 417/379
2004/0193237 A1 * 9/2004 Krueger ..... 607/96

FOREIGN PATENT DOCUMENTS

JP 2002-371955 * 12/2002
JP 2003-211701 A 7/2003

OTHER PUBLICATIONS

Machine Language Translation of Japanese Patent JP2002/371955 to Sanuki, date of publication: Dec. 26, 2002.*

* cited by examiner

*Primary Examiner*—Devon C Kramer
*Assistant Examiner*—Dnyanesh Kasture
(74) *Attorney, Agent, or Firm*—Sughrue Mion, PLLC

(57) ABSTRACT

A simple structured thermal actuation pump for reducing energy loss is provided. The thermal actuation pump includes: a first chamber having at least one working fluid inlet and at least one working fluid outlet; a second chamber having at least one working fluid inlet and at least one working fluid outlet; and a thermoelectric element arranged between the first chamber and the second chamber and including one side being cooled and the other side being heated according to a direction of current for changing inside pressures of the first chamber and the second chamber.

14 Claims, 4 Drawing Sheets

THERMAL ACTUATION PUMP

CROSS-REFERENCE TO RELATED APPLICATIONS

This application claims the benefit under 35 U.S.C. §119 (a) of Korean Patent Application No. 2004-73413, filed on Sep. 14, 2004, in the Korean Intellectual Property Office, the entire contents of which are incorporated herein by reference.

BACKGROUND OF THE INVENTION

1. Field of the Invention

The present invention relates to a pump transferring a fluid and, more particularly, to a thermal actuation pump using a thermoelectric element.

2. Description of the Related Art

Rapid progression of a micro-machining technology has resulted in the development of various functions of a micro electro mechanical system (MEMS). The MEMS has many advantages in view of size, cost and reliability. Therefore, the MEMS has been developed for wide fields of application.

In particular, there have been many studies in progress for integrating a fluid system and embodying the integrated fluid system on single chip. A micro pump is a major element of the integrated fluid system for transferring a working fluid.

A thermal actuation pump has been used as the micro pump. Conventionally, the thermal actuation pump includes a chamber with an inlet and an outlet, and a heating unit such as a heater for heating the chamber. For operating the thermal actuation pump, electric power is supplied to the heating unit. The chamber is heated by the heating unit and a gas in the chamber is expanded. Accordingly, an inside pressure of the chamber increases and the gas in the chamber flows out through the outlet. On the contrary, if the gas in the chamber is contracted by cooling the heating unit, the inside pressure of the chamber decreases. Accordingly, external gas flows in the chamber through the inlet.

As mentioned above, the conventional thermal actuation pump requires an additional cooling device such as a heat sink for cooling the heated heating unit. However, it is a very complicated process to implement the cooling device in the integrated pump. Also, the structure of the integrated pump becomes complex. Furthermore, the heat generated from the heating unit cannot be re-used since the heat sink must cool the generated heat for decreasing the inside pressure of the chamber. Therefore, the conventional thermal actuation pump consumes a comparatively large amount of energy for heating and cooling the heating unit.

SUMMARY OF THE INVENTION

Accordingly, the present general inventive concept has been made to solve the above-mentioned problems, and an aspect of the present general inventive concept is to provide a simple structured thermal actuation pump for effectively consuming energy in order to reduce energy loss.

In accordance with an aspect of the present invention, there is provided a thermal actuation pump, including: a first chamber having at least one working fluid inlet and at least one working fluid outlet; a second chamber having at least one working fluid inlet and at least one working fluid outlet; and a thermoelectric element arranged between the first chamber and the second chamber and including one side being cooled and the other side being heated according to a direction of current.

In accordance with an exemplary embodiment of the present invention, a check valve may be included in the working fluid inlet and the working fluid outlet, and the thermal actuation pump may further includes a controller for controlling the direction of the current supplied to the thermoelectric element according to information including a temperature, a pressure and a time for supplying the current of the first and the second chambers.

In accordance with another exemplary embodiment of the present invention, the thermal actuation pump includes a membrane for separating at least one of the first chamber and the second chamber into a working fluid chamber and a driving fluid chamber.

BRIEF DESCRIPTION OF THE DRAWINGS

The above aspects and features of the present invention will be more apparent by describing certain exemplary embodiments of the present invention with reference to the accompanying drawings, in which.

Figure 1A:
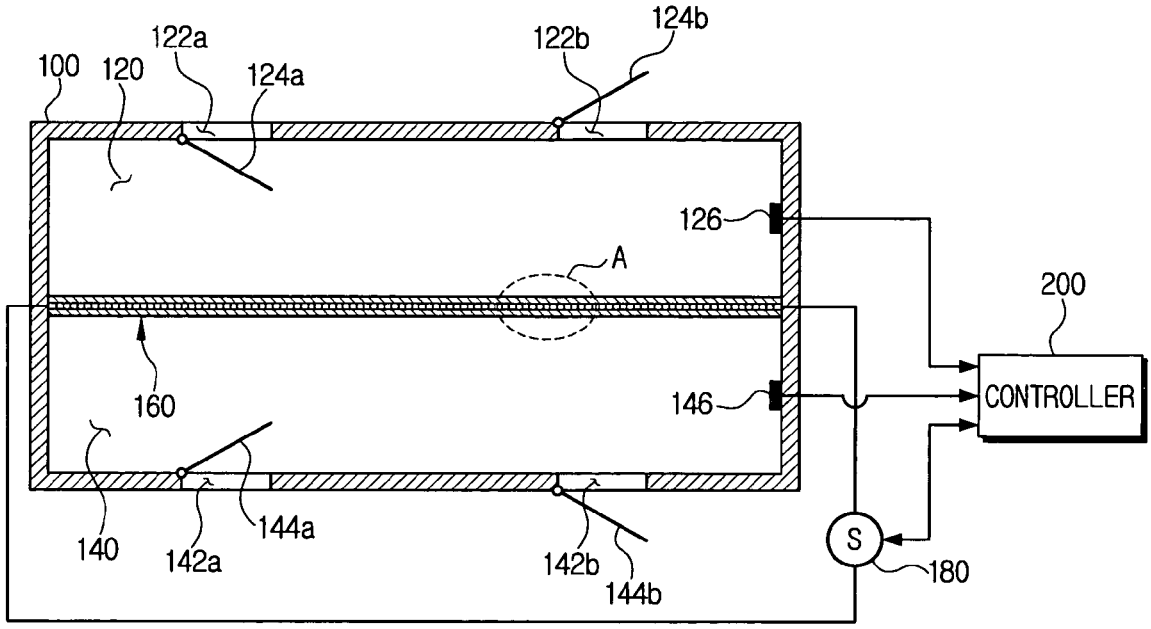
FIG. 1A is a cross sectional view of a thermal actuation pump in accordance with an exemplary embodiment of the present invention.

DETAILED DESCRIPTION OF THE ILLUSTRATIVE, NON-LIMITING EMBODIMENTS OF THE INVENTION

Certain illustrative, non-limiting embodiments of the present invention will be described in greater detail with reference to the accompanying drawings.

In the following description, the same drawing reference numerals are used for the same elements even in different drawings. The matters defined in the description such as a detailed construction and elements are only provided to assist in a comprehensive understanding of the invention. Thus, it is apparent that the present invention can be carried out without those defined matters. Also, well-known functions or constructions are not described in detail since they would obscure the invention in unnecessary detail.

Figure 1B:
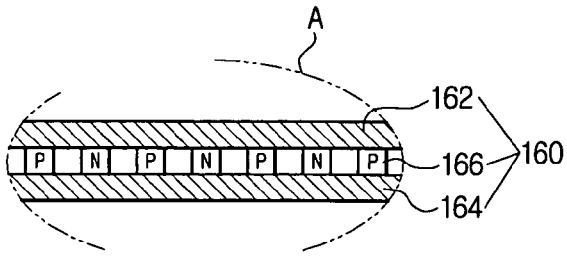
FIG. 1B is a detailed diagram of a part 'A' in a thermal actuation pump in FIG. 1A.

FIG. 1A is a cross sectional view of a thermal actuation pump in accordance with an exemplary embodiment of the present invention and FIG. 1B is a detailed diagram of a part A in the thermal actuation pump in FIG. 1A.

Referring to FIGS. 1A and 1B, the thermal actuation pump includes a housing 100, a first chamber 120 arranged in an upper part of the inside of housing 100, a second chamber 140 arranged in a bottom part of the inside of housing 100, a thermoelectric element 160 arranged between the first chamber 120 and the second chamber 140, a power supply 180 for supping electric power to the thermoelectric element 160 and a controller 200.

As shown in FIG. 1A, the first chamber 120 and the second chamber 140 have inlets 122*a*, 142*a* and outlets 122*b*, 142*b*, respectively. Also, check valves 124*a*, 124*b*, 144*a*, 144*b* are included in each of the inlets 122*a*, 142*a* and the outlets 122*b*, 142*b*, respectively, for guiding the working fluid to flow in and out in a predetermined direction. Sensors 126 and 146 are included in the first chamber 120 and the second chamber 140, respectively, for sensing, for example, a temperature and a pressure of the first and the second chambers 120 and 140.

With reference to FIG. 1B, the thermoelectric element 160 includes a first plate 162 that faces the first chamber 120 and a second plate 164 that faces the second chamber 140. A semiconductor layer 166 is interposed between the first and the second plates 162 and 164. The semiconductor layer 166 is connected to the power supply and electric power is supplied to the semiconductor layer 166. According to a direction of supplied current, the first and the second plates 162 and 164 are selectively heated or cooled. That is, a peltier effect of the thermoelectric element 160 is generated. For example, when the electric power is supplied to the semiconductor layer 166, the first plate 162 is cooled by absorbing heat of the first plate 162. The absorbed heat is transferred to the second plate 164 and the second plate 164 is heated by transferred heat. If the direction of current supplied from the power supply 180 is reversed and the reversed direction of the current is supplied to the semiconductor layer 166, the second plate 164 is cooled and heat absorbed from the second plate 164 is transferred to the first plate 162. Accordingly, the first plate 162 is heated and the second plate 164 is cooled. In other words, heating and cooling take place reversely by changing the direction of the current. The above mentioned thermoelectric element 160 generating the peltier effect per se is well known to those skilled in the art. Therefore, a detailed explanation is omitted.

The controller 200 compares data detected from the sensors 126 and 146. According to the comparison result, the controller 200 controls the power supply 180 for supplying the electric power to the semiconductor layer 166 and decides the direction of the current.

Hereinafter, the operation of the thermal actuation pump is explained with referring to the FIGS. 2A and 2B.

Figure 2A:
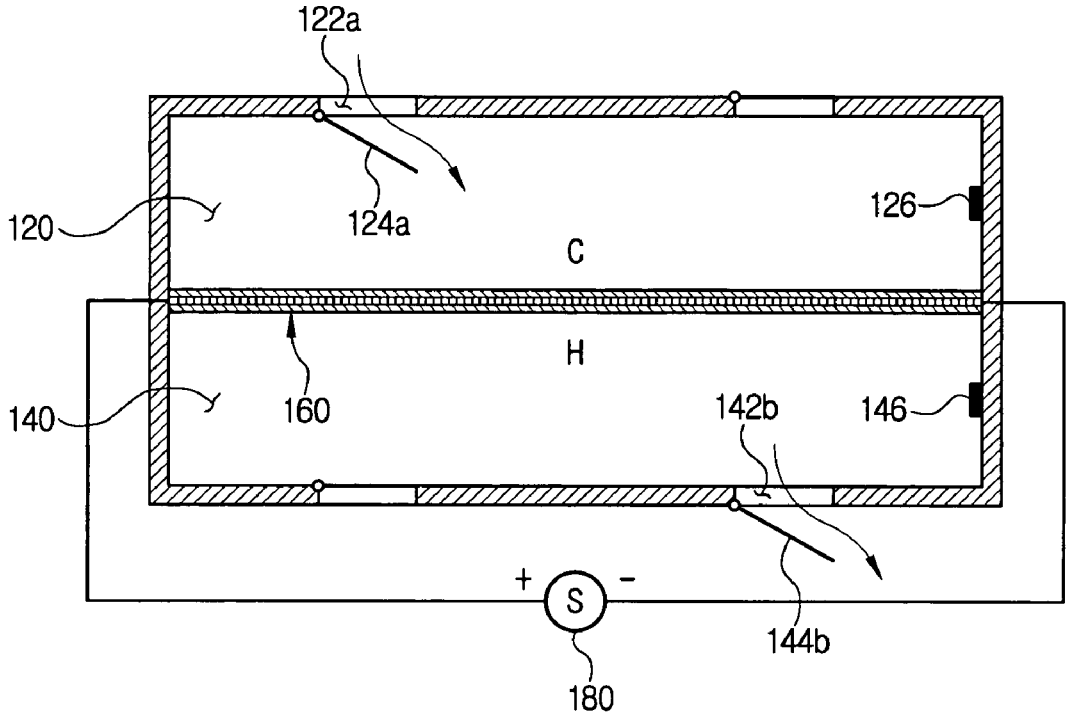
FIGS. 2A and 2B are cross sectional views for explaining the operation of a thermal actuation pump in FIG. 1A.
Figure 2B:
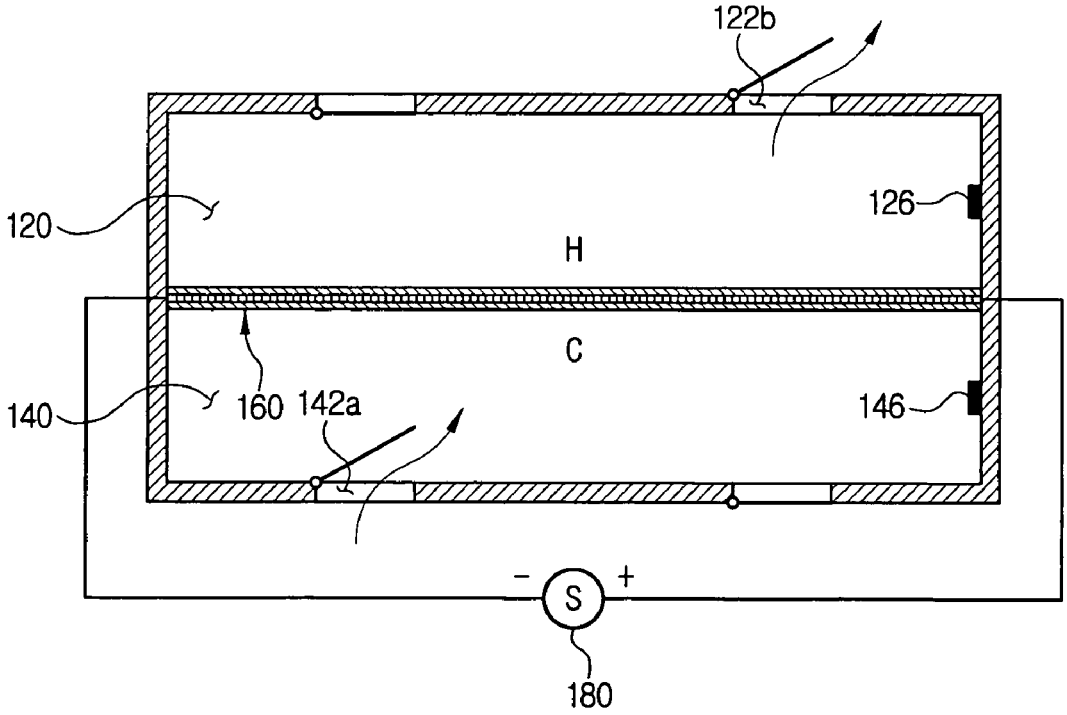

As shown in the FIGS. 2A and 2B, the power supply 180 supplies electric power to the thermoelectric element 160. The thermoelectric element 160 absorbs heat of the first chamber 120 and transfers the absorbed heat to the second chamber 140. Accordingly, gas in the first chamber 120 is cooled and contracted and a pressure of the first chamber 120 becomes lower than an external pressure. Accordingly, the check valve 124*a* of the first inlet 122*a* is opened by the difference between the external pressure and the pressure of the first chamber 120. Therefore, external gas flows into the first chamber 120 through the first inlet 122*a*. By transferring the absorbed heat to the second chamber 140, gas in the second chamber 140 is heated and expanded. Accordingly, a pressure of the second chamber 140 becomes higher than the external pressure. Therefore, the check valve 144*b* of the second outlet 142*b* is opened and the gas in the second chamber 140 flows out to the exterior through the second outlet 142*b*.

The sensors 126 and 146 detect information about the first chamber 120 and the second chamber 140 such as temperature, and pressure, and transfer the detected information to the controller 200. The controller 200 compares preset information and the transferred information. The preset information includes a predetermined temperature, and a predetermined pressure. The controller 200 determines whether a target operation is achieved by comparing the preset information and the transferred information. If the target operation is not achieved, the controller 200 controls the power supply 180 to continuously supply current in the identical direction. If the target operation is achieved, the controller 200 determines whether the pumping operation is ended or not.

If the pumping operation is not ended, as shown in FIG. 2B, the controller 200 controls the power supply 180 to change the direction of the current. If the direction of the supplied current is changed, the thermoelectric element 180 absorbs heat of the second chamber 160 and discharges the absorbed heat to the cooled first chamber 120. Accordingly, the gas in the second chamber 140 is cooled and contracted. Therefore, a pressure of the second chamber 140 decreases and external gas flows in the second chamber 140 through the second inlet 142*a*. By the adsorbed heat, the gas in the first chamber 120 is heated and expanded. Accordingly, the pressure of the first chamber 120 is increased and the inside gas of the first chamber flows out to exterior through the first outlet 122*b*. As mentioned above, the absorbed heat for cooling the second chamber 120 is transferred to the first chamber 120 and the first chamber 120 is heated by the transferred heat.

As described above, the heat generated at the second chamber 140 is reused by absorbing the heat of the second chamber 140 and transferring the absorbed heat to the first chamber 120. That is, the heat generated inside second chamber 140 is reused for heating the first chamber 120. Accordingly, the thermal actuation pump of the present invention consumes less energy when compared to the conventional thermal actuation pump. Also, the thermal actuation pump has a simple structure and effectively performs a pumping operation by simultaneously driving two chambers 120 and 140.

Figure 3:
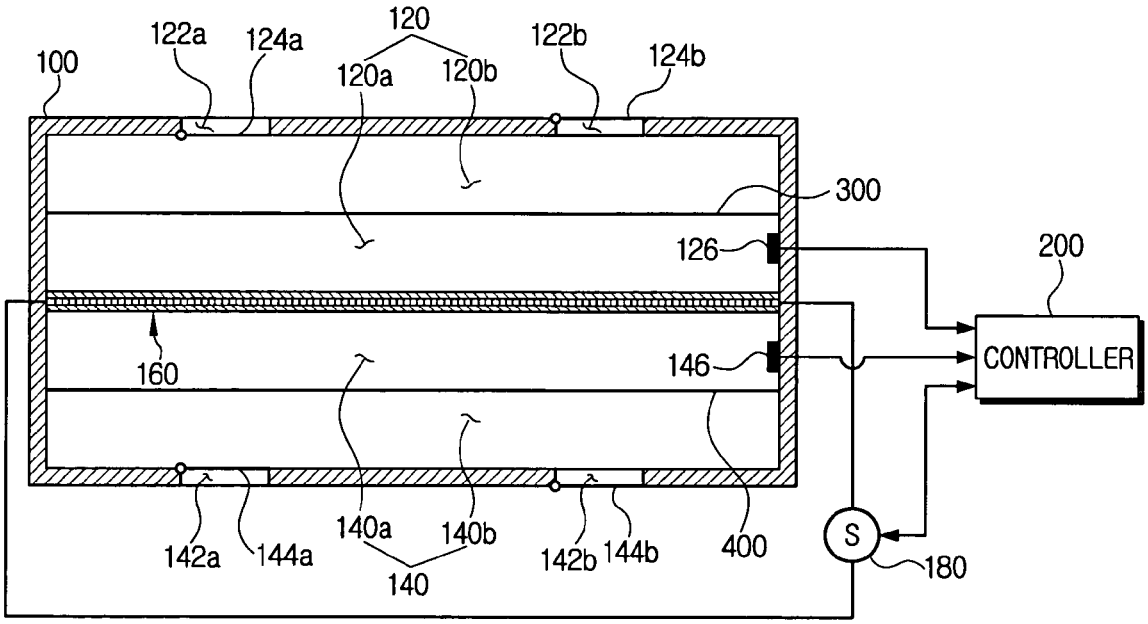
FIG. 3 is a cross sectional view of a thermal actuation pump in accordance with another exemplary embodiment of the present invention.

FIG. 3 is a cross sectional view of a thermal actuation pump in accordance with another exemplary embodiment of the present invention. Hereinafter, the further embodiment of the present invention is explained by referring to FIG. 3. Like reference numerals in the FIGS. 1 and 3 refer to like elements. As shown in FIG. 3, the first chamber 120 includes a first membrane 300 for separating the first chamber 120 to a first driving fluid chamber 120*a* and a first working fluid chamber 120*b*. Also, the second chamber 140 includes a second membrane 400 for separating the second chamber 140 to a second driving fluid chamber 140*a* and a second working fluid chamber 140*b*. The driving fluid chambers 120*a* and 140*a* are communicated with the thermoelectric element 160 and may be filled with a driving fluid for driving a working fluid. It is preferable, but not necessary, to use a gaseous state of a fluid because a volume of the fluid in the gaseous state is easily transformed by heat. The first working fluid chamber 120*b* includes a first inlet 122*a* and a first outlet 122*b*. Also, the second working fluid chamber 140*b* includes a second inlet 142*a* and a second outlet 142*b*. The inlets 122*a*, 142*a* and the outlets 122*b*, 142*b* are included for the working fluid to flow in and out of the working chambers 120*b* and 140*b*. The working fluid may be a liquid or a gas. The membranes 300 and 400 are attached to inner walls of the housing 100 for maintaining airtightness and/or liquid tightness of the driving fluid chambers and the working fluid chambers. That is, the driving fluid chambers 120*a*, 140*a* and the working fluid chambers 120*b*, 140*b* are sealed by the membranes 300 and 400 for preventing the working fluid to be mixed or contacted with the driving fluid. That is, it prevents the working fluid from being polluted by the driving fluid.

Hereinafter, the operation of the thermal actuation pump in accordance with the further embodiment of the present invention are explained by referring FIGS. 4A and 4B.

Figure 4A:
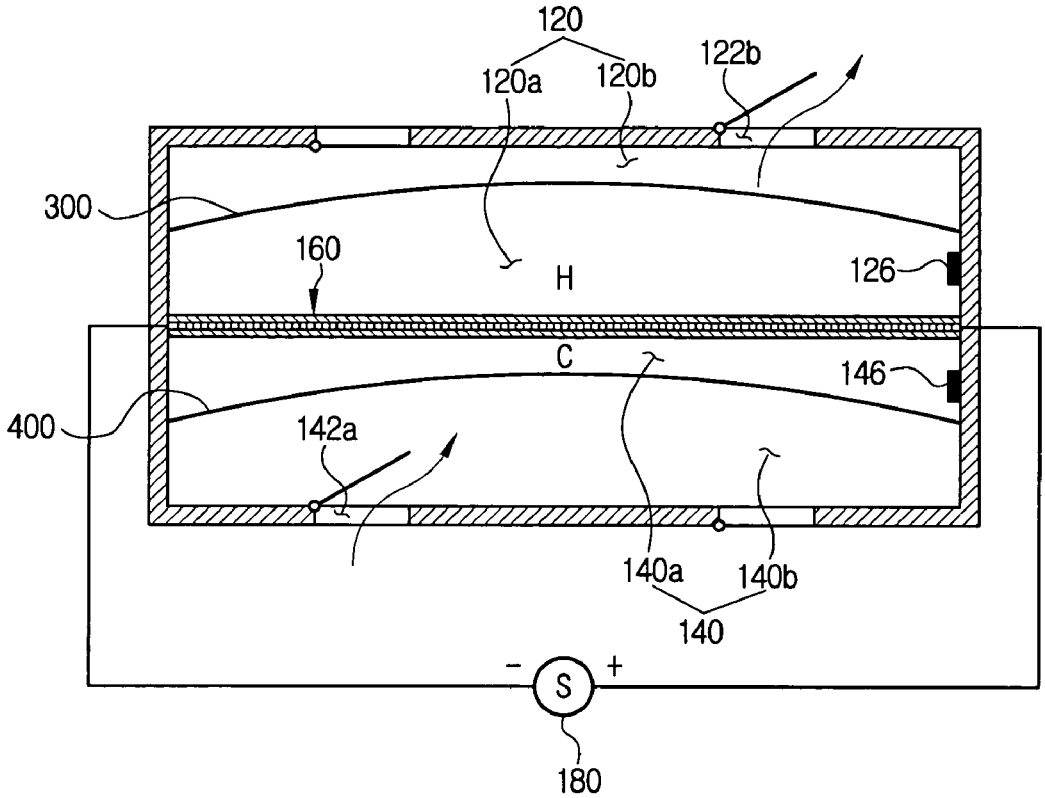
FIGS. 4A and 4B are cross sectional views for explaining the operation of a thermal actuation pump in FIG. 3.
Figure 4B:
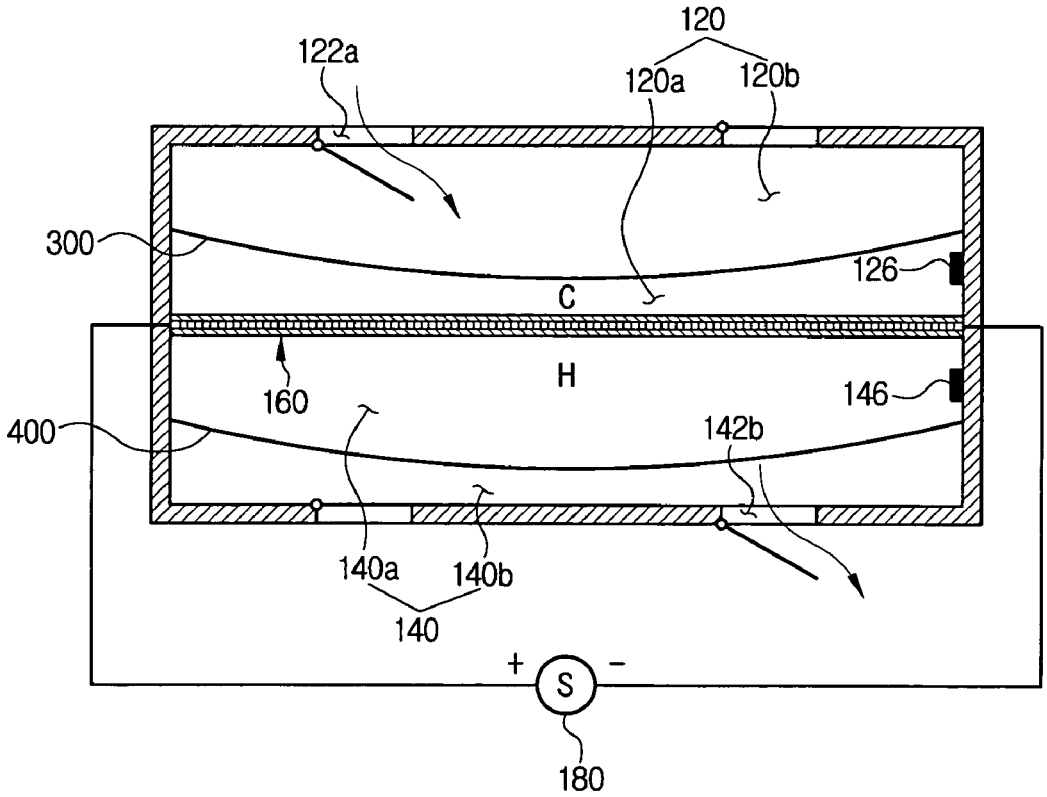

Referring FIGS. 4A and 4B, the power supply 180 supplies electric power to the thermoelectric element 160 and the first driving fluid chamber 120*a* of the first chamber 120 is heated by the thermoelectric element 160. Accordingly, the driving fluid is expanded by the heated first driving fluid chamber 120*a* and the first membrane 300 is expanded toward the first working fluid chamber 120*b* by the expanded driving fluid. The expanded first membrane 300 reduces a volume of the first working fluid chamber 120*b* and thus the working fluid in the first working fluid chamber 120*b* flows out to the exterior through the first outlet 122*b*. And, the second driving fluid chamber 140*a* is cooled and the driving fluid in the second driving fluid is contracted. That is, a pressure of the second driving fluid chamber 140*a* decreases. Accordingly, the second membrane 400 is pulled toward the thermoelectric element 160 by contraction of the driving fluid and thus a volume of the second membrane 400 increases. That is, the pressure of the second driving fluid chamber 140*b* is reduced. Accordingly, external working fluid flows in the second working fluid chamber 140*b*.

If the above operation is ended, the controller 200 controls the power supply 180 to change a direction of current to the thermoelectric element 160. If the direction of the current is changed, the first driving fluid chamber 120*a* is contracted for contracting the first membrane 300 and the external working fluid flows in the first working fluid chamber 120*b* through the first inlet 122*a* by contraction of the first membrane 300. Also, the second driving fluid chamber 140*a* is expanded and the second membrane 400 is expanded toward the bottom side of the second working fluid chamber 140*b*. Accordingly, the working fluid of the second working fluid chamber 140*b* flows out to the exterior through the second outlet 142*b*.

As described above, the thermal actuation pump has a simple structure by arranging the thermoelectric element between the first chamber and the second chamber compared to the conventional thermal actuation pump. The thermal actuation pump effectively performs the pumping operation by simultaneously driving the first and the second chambers Furthermore, the thermal actuation pump of the present invention consumes less energy compared to the conventional pump because heat transferred to one of chambers from the thermoelectric element is reused by absorbing the heat from the heated chamber and transferring the absorbed heat to other chamber without cooling out.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A thermal actuation pump, comprising:

a first chamber having at least one fluid inlet and at least one fluid outlet;

a second chamber having at least one fluid inlet and at least one fluid outlet; and a thermoelectric element arranged between the first chamber and the second chamber and including one side being cooled and the other side being heated according to a direction of current supplied to the thermoelectric element;

wherein the thermoelectric element is configured to adjust a temperature of fluid in the first chamber and a temperature of fluid in the second chamber according to the direction of the current; and wherein the fluids in the first and the second chambers are separated from each other by and are in direct contact with plane plates, which form the one side and the other side of the thermoelectric element without being filled with the fluids, respectively, so that the respective fluids of the first and the second chambers separately and oppositely flow in or out by being selectively heated or cooled by the one side and the other side of the thermoelectric element, respectively.

2. The thermal actuation pump of claim 1, wherein each of the fluid inlets and the fluid outlets includes a check valve.

3. The thermal actuation pump of claim 1, further comprising:

a sensor for sensing a temperature and a pressure of the first chamber and the second chamber;

a power supply for supplying the current to the thermoelectric element; and a controller for controlling a direction of the current supplied by the power supply to the thermoelectric element.

4. The thermal actuation pump of claim 3, wherein the controller controls the direction of the current based on at least one of information including a temperature, a pressure and a time for supplying the current of the first chamber and the second chamber.

5. The thermal actuation pump of claim 1, further comprising:

a membrane for separating at least one of the first chamber and the second chamber into a working fluid chamber and a driving fluid chamber.

6. The thermal actuation pump of claim 1, further comprising:

a first membrane separating the first chamber into a first working chamber comprising working fluid and a first driving chamber comprising driving fluid; and a second membrane separating the second chamber into a second working chamber comprising working fluid and a second driving chamber comprising driving fluid.

7. The thermal actuation pump of claim 6, wherein the first and the second driving fluid chambers are filled with a gaseous state of a driving fluid.

8. The thermal actuation pump of claim 1, wherein the thermoelectric element comprises:

a first plate adjacent to the first chamber;

a second plate adjacent to the second chamber; and a semiconductor layer interposed between the first plate and the second plate.

9. The thermal actuation pump of claim 1, wherein the thermoelectric element is configured to decrease the temperature of the fluid in the first chamber and increase the temperature of the fluid in the second chamber according to a first direction of the current.

10. The thermal actuation pump of claim 9, wherein the thermal actuation pump is configured such that the decrease in the temperature of the fluid in the first chamber causes fluid to flow through the at least one fluid inlet of the first chamber.

11. The thermal actuation pump of claim 10, wherein the thermal actuation pump is configured such that the increase in the temperature of the fluid in the second chamber causes fluid to flow through the at least one fluid outlet of the second chamber.

12. The thermal actuation pump of claim 9, wherein the thermoelectric element is configured to increase the temperature of the fluid in the first chamber and decrease the temperature of the fluid in the second chamber according to a second direction of the current.

13. The thermal actuation pump of claim 12, wherein the thermal actuation pump is configured such that the increase in the temperature of the fluid in the first chamber causes fluid to flow through the at least one fluid outlet of the first chamber.

14. The thermal actuation pump of claim 13, wherein the thermal actuation pump is configured such that the decrease in the temperature of the fluid in the second chamber causes fluid to flow through the at least one fluid inlet of the second chamber.

* * * * *